United States Patent [19]

Koshiyama et al.

[11] 4,226,623

[45] Oct. 7, 1980

[54] METHOD FOR POLISHING A SINGLE CRYSTAL OR GADOLINIUM GALLIUM GARNET

[75] Inventors: Isamu Koshiyama, Nagoya; Yoshisuke Naitou, Aichi, both of Japan

[73] Assignee: Fujimi Kenmazai Kogyo Co., Ltd., Aichi, Japan

[21] Appl. No.: 100,497

[22] Filed: Dec. 5, 1979

[30] Foreign Application Priority Data

Feb. 19, 1979 [JP] Japan ..... 54-18590

[51] Int. Cl.[3] ..... B24B 1/00; C09G 1/02

[52] U.S. Cl. ..... 106/3; 51/308; 51/309

[58] Field of Search ..... 51/283 R, 308, 309, 51/293; 106/3

[56] References Cited

U.S. PATENT DOCUMENTS

| | | | |
|---|---|---|---|
| 2,275,049 | 3/1942 | Keller | 51/308 |
| 3,328,141 | 6/1967 | Lachapelle | 51/309 |
| 3,429,080 | 2/1969 | Lachapelle | 51/309 |
| 3,877,183 | 4/1975 | Deckert et al. | 51/308 |
| 4,022,625 | 5/1977 | Shelton | 106/3 |
| 4,064,660 | 12/1977 | Lampert | 51/308 |
| 4,122,160 | 10/1978 | Wason | 51/308 |
| 4,169,337 | 10/1979 | Payne | 51/308 |

*Primary Examiner*—Donald J. Arnold

*Attorney, Agent, or Firm*—Koda and Androlia

[57] ABSTRACT

A mechanochemical method of polishing a gadolinium gallium garnet single crystal characterized by the use of a composition made of a polishing agent selected from the group consisting of aluminum oxide, cerium oxide, zirconium oxide and chromium oxide suspended in an alkaline silicate solution selected from a group consisting of sodium silicate solution and potassium silicate solution.

11 Claims, No Drawings

METHOD FOR POLISHING A SINGLE CRYSTAL OR GADOLINIUM GALLIUM GARNET

BACKGROUND OF THE INVENTION

1. Field of the Invention

The present invention relates to a method of polishing a non-magnetic gadolinium gallium garnet (GGG) single crystal which is used as a base board for the epitaxial growth of a magnetic thin bubble element.

2. Prior Art

In the prior art there exists methods for polishing GGG single crystal. In such conventional methods, a polishing agent is either mixed with water to make a suspended solution or shaped into a grindstone. If such a method is applied to the base board surface of GGG single crystal, however, a surface defect commonly known as orange peel or microscopic scratches result on the polished base board surface. A commonly known method of polishing semiconductor crystals such as silicon single crystals is a mechanochemical method using a suspended mixed solution of an alkaline solution such as sodium hydroxide, potassium hydroxide, etc. and a polishing agent such as silicon dioxide and zirconium oxide. It is difficult, however, to prevent the occurrence of orange peel and microscratches by applying this method to the base board of GGG single crystals. One of the polishing methods for obtaining a crystalline base board surface for epitaxial growth with few surface defects such as orange peels and microscratches is to use colloidal silica as a polishing agent. However, since this method has very low polishing efficiency, it takes a long time to obtain a smooth and satisfactory surface.

SUMMARY OF THE INVENTION

Accordingly, it is the general object of the present invention to provide a method for polishing GGG single crystals which produces few surface defects such as orange peel and microscratches.

It is another object of the present invention to provide a method of polishing GGG single crystals which has a high polishing efficiency.

In keeping with the principles of the present invention, the objects are accomplished by a unique polishing method for GGG single crystals. Such polishing method is a mechanochemical polishing method using a composition made from a polishing agent selected from a group consisting of aluminum oxide, cerium oxide, zirconium oxide and chromium oxide suspended in an alkaline silicate solution selected from the group consisting of sodium silacate solution and potassium silicate solution.

DETAILED DESCRIPTION OF THE INVENTION

In the present invention, an alkaine silicate solution with a weight ratio of silicon dioxide less than 15% is used. Preferably, one with a weight ration greater than 0.06% and less than 10% is used. For the polishing agent, a polishing agent which is as small as possible is used. Preferably the polishing agent should have granular diameter less than 1μ. The composition made of a polishing agent suspended in an alkaline silicate solution is preferably used having a weight ratio of the polishing agent greater than 2% and less than 30%.

The machine that is utilized in the polishing method of the present invention can be any polisher commonly used for polishing semiconductor crystals or lenses. In such a machine the polishing pad can be felt or some other type of material such as Politex Supreme of Geoscience Corp. or Microcloth of Buehler, Limited.

In the following paragraphs are examples of the present invention.

EXAMPLES 1–6

The compositions used in Examples 1–6 are made of aluminum oxide with a granular diameter less than 1μ suspended with a weight ration of 10% in a sodium silicate solution containing silicon dioxide ($SiO_2$) in weight ratios of 0.06, 0.5, 1.0, 5.0, 10.0 and 15.0, respectively.

The composition used in Comparative Example 1 is a colloidal silica (SYTON-HT-30 produced by Monsanto Company) containing 30% by weight of silicon dioxide.

The composition used in Comparative Example 2 is made of aluminum oxide having a granular diameter less than 1μ suspended in water with a weight ratio of 10%.

In Examples 1–6 and in Comparative Examples 1 and 2, a thin slice of GGG single crystal of 50 mm diameter and 0.5 mm thickness, which had been lapped by using aluminum oxide with an average granular diameter of less than 10μ in advance, was placed on a polishing pad (Politex Supreme) of a diamter of 240 mm attached to the rotary board of a polisher. And the thin slice was polished for one hour at a polishing pressure of 75 g/cm$^2$ and rotational velocity of 260 rpm. The compositions for Examples 1–6 and Comparative Examples 1 and 2 were dropped onto the rotating polishing pad at a rate of 10 cc/minute between the polishing pad and the thin slice which are moving with respect to one another.

After polishing, the decrease in thickness of the thin slice was measured in order to obtain the polished amount and the quality of the polished surface was examined either by direct obversation or by magnification. The results of the examinations are shown in Table 1.

Table 1

| No. | | Weight ratio of $SiO_2$ within sodium silicate solution | Polished amount | Quality of polished surface |
|---|---|---|---|---|
| Ex. | 1 | 0.06% | 4.6μ/hr | good |
| | 2 | 0.5 | 6.8 | " |
| | 3 | 1.0 | 6.8 | " |
| | 4 | 5.0 | 5.6 | " |
| | 5 | 10.0 | 4.2 | " |
| | 6 | 15.0 | 3.4 | " |
| Comp. Ex. | 1 | | 2.8μ/hr | " |
| | 2 | | 3.2 | Occurrence of orange peels |

This table clearly shows that it is possible to polish a thin slice of GGG single crystal without destroying the quality of the polished surface and with high polishing efficiency by the method of Examples 1–6 as compared to the methods of Comparative Examples 1 and 2.

It should be noted that if the weight ratio of silicon dioxide exceeds 15% in the sodium silicate solution, the composition made of aluminum oxide suspended in the sodium silicate solution tends to remain between the thin slice and the polishing pad as a result of the increased viscosity. This causes slippage between the thin slice and the polishing pad which move relative to one another and thus lowers the polishing efficiency.

EXAMPLES 7–9

The compositions used in Examples 7–9 are made of cerium oxide, zirconium oxide and chromium oxide, respectively, with a granular diameter less than 1μ with a weight ratio of 10% in a sodium silicate solution containing 1.0% by weight of silicon dioxide. The same polishing method is utilized as was used in Examples 1–6.

The composition used in Comparative Example 3 was made of zirconium oxide with a granular diameter of less than 1μ suspended with a weight ratio of 10% in a sodium hydroxide solution containing 1.0% by weight of sodium hydroxide. The same polishing method was again used in Examples 1–6.

In the Examples 7–9 and Comparative Example 3, the measurements were made by the same method as in the Examples 1–6 and the results are shown in Table 2.

Table 2

| No. | | Kind of polishing agent | Polished amount | Quality of polished surface |
|---|---|---|---|---|
| Ex. | 7 | Cerium oxide | 4.6μ/hr | good |
| | 8 | Zirconium oxide | 4.0 | " |
| | 9 | Chromium oxide | 4.4 | " |
| Com. Ex. | 3 | | 2.6 | Occurrence of orange peels |

From Table 2 it can be clearly seen that it is possible to polish with a high polishing efficiency without destroying the quality of the polished surface by means of the methods of Examples 7–9 as compared to the method of Comparative Example 3, as well as the methods of Comparative Examples 1 and 2 of Table 1.

EXAMPLES 10–15

The compositions used in Examples 10–15 are made of aluminum oxide or cerium oxide with a granular diameter less than 1μ suspended with a weight ratio of 10% in a potassium silicate solution containing 0.5, 1.0 or 5.0% by weight of silicon dioxide. The same polishing method was used as in Examples 1–6.

The results of the polishing process were measured by the same method as in Examples 1–6, and the results are shown in Table 3.

Table 3

| No. | | Weight ratio of $SiO_2$ within potassium silicate solution | Kind of polishing agent | Polished amount | Quality of polished surface |
|---|---|---|---|---|---|
| Ex. | 10 | 0.5% | Aluminum oxide | 5.6μ/hr | good |
| | 11 | 1.0 | Aluminum oxide | 6.0 | " |
| | 12 | 5.0 | Aluminum oxide | 5.0 | " |
| | 13 | 0.5 | Cerium oxide | 3.7 | " |
| | 14 | 1.0 | Cerium oxide | 4.0 | " |
| | 15 | 5.0 | Cerium oxide | 3.2 | " |

The above described examples clearly show that the polishing method of the present invention enables one to polish the base board surface of GGG single crystals without destroying the quality of the polished surface and with high polishing efficiency.

It should be apparent to those skilled in the art that the above described examples are merely a few of the many possible specific examples which represent the applications and principles of the present invention. Numerous and various other arrangements can be readily devised by those skilled in the art without departing from the spirit and scope of the invention.

We claim:

1. A mechanochemical method of polishing a gadolinium gallium garnet single crystal characterized by polishing said gadolinium gallium garnet single crystal with a composition comprising a polishing agent selected from the group consisting of aluminium oxide, cerium oxide, zirconium oxide or chromium oxide suspended within an alkaline silicate solution selected from the group consisting of sodium silicate solution or potassium silicate solution.

2. The polishing method described in claim 1, wherein said polishing agent is aluminum oxide and said alkaline silicate solution is sodium silicate solution.

3. The polishing method described in claim 1, wherein said polishing agent is cerium oxide and said alkaline silicate solution is sodium silicate solution.

4. The polishing method described in claim 1, wherein said polishing agent is zirconium oxide and said alkaline silicate solution is sodium silicate solution.

5. The polishing method described in claim 1, wherein said polishing agent is chromium oxide and said alkaline silicate solution is sodium silicate solution.

6. The polishing method described in claim 1, wherein said polishing agent is aluminium oxide and said alkaline silicate solution is potassium silicate solution.

7. The polishing method described in claim 1, wherein said polishing agent is cerium oxide and said alkaline silicate solution is potassium silicate solution.

8. The polishing method described in claim 1 or 2, wherein the weight ratio of silicon dioxide within said alkaline silicate solution is less than 15%, the granular diameter of said polishing agent is less than 1μ, and the weight ratio of polishing agent in said composition is greater than 2% and less than 30%.

9. The polishing method described in claim 8, wherein the weight ratio of silicon dioxide within said alkaline silicate solution is greater than 0.06% and less than 10.0%.

10. The polishing method described in claim 2, wherein the weight ratio of silicon dioxide within said alkaline silicate solution is greater than 0.5% and less than 1.0%, the granular diameter of said polishing agent is less than 1μ, and the weight ratio of said polishing agent within said composition is greater than 2% and less than 30%.

11. The polishing method described in claim 6 or 7, wherein the weight ratio of silicon dioxide within said alkaline silicate solution is greater than 0.5% and less than 5.0%, the granular diameter of said polishing agent is less than 1μ, and the weight ratio of said polishing agent with said composition is greater than 2% and less than 30%.

* * * * *